United States Patent [19]

Montgomery

[11] 4,365,721

[45] Dec. 28, 1982

[54] CHILD RESISTANT CLOSURE AND CONTAINER ASSEMBLY

[75] Inventor: Gary V. Montgomery, Evansville, Ind.

[73] Assignee: Sunbeam Plastics Corporation, Evansville, Ind.

[21] Appl. No.: 282,044

[22] Filed: Jul. 10, 1981

[51] Int. Cl.[3] ..... B65D 55/02

[52] U.S. Cl. ..... 215/217; 215/206; 215/224

[58] Field of Search ..... 215/206, 217, 223, 224

[56] References Cited

U.S. PATENT DOCUMENTS 4,071,156 1/1978 Lowe ..... 215/224

4,157,142 6/1979 Kong ..... 215/206 X

*Primary Examiner*—George T. Hall

*Attorney, Agent, or Firm*—Fisher, Gerhardt, Crampton & Groh

[57] ABSTRACT

A container and closure assembly having complementary engaging threads on the closure and container which are used for closing the container but which do not afford opening movement because of a one-way stop arrangement. Opening movement requires orientation to a predetermined location followed by tilting of the cap to open the container and remove the closure therefrom.

11 Claims, 10 Drawing Figures

Fig-6
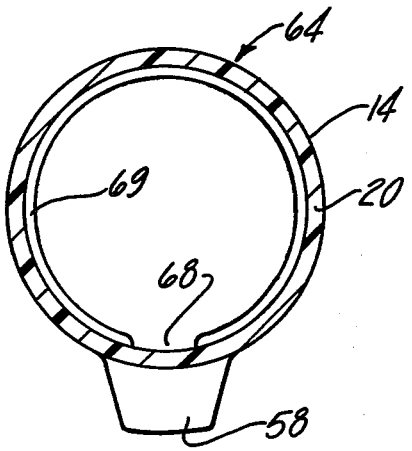
Fig-7
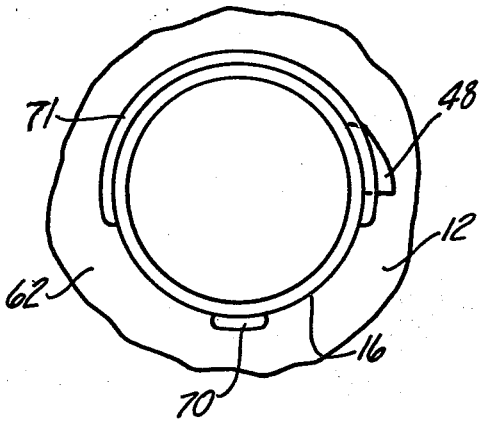
Fig-8
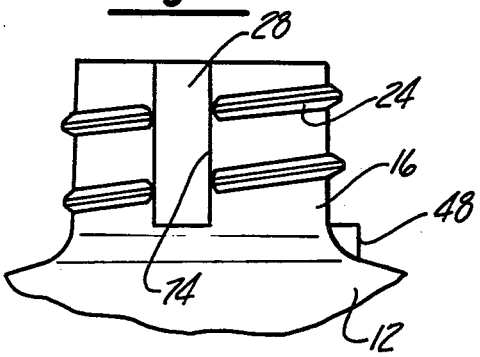
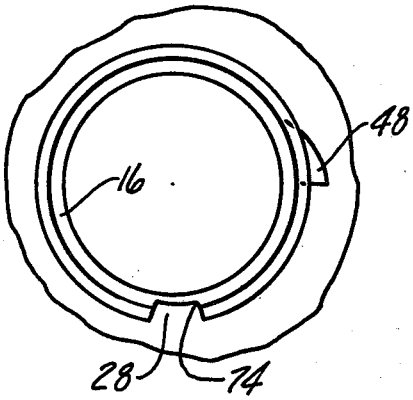
Fig-9
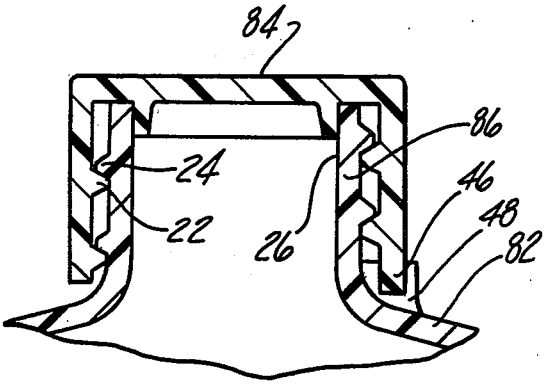
Fig-10

CHILD RESISTANT CLOSURE AND CONTAINER ASSEMBLY

This invention relates to child-resistant containers and closures.

A variety of child-resistant closures and containers have been developed, each having its advantages and disadvantages. Two types of such closure and container arrangements can be generally classified as threaded type in which the closure is threaded on or off of a container and the snap type in which the closure is snapped on to close and tilted relative to the container to open. Of these the snap type typically is the simplest because it can be made in a single piece and usually has a smaller overall profile than threaded types of closures. Unfortunately, the snap type closure arrangements cannot effectively be used for packaging liquids because the pressures which must be generated between the closure and the container to avoid leakage are so high that opening to remove the closure from the container usually requires a tool. Threaded type containers have the advantage that the pressures required to bring about sealing can be easily generated but have the disadvantage that the closure has a larger profile than snap type caps and frequently require more than one part.

It is an object of the invention to provide a closure and container assembly which utilizes the advantages of screw type and snap type closures and avoids their disadvantages.

Another object of the invention is to provide a closure and container assembly in which the arrangement works as a screw type package in the closing direction and a snap or tilt type arrangement in the opening direction.

The objects of the invention are accomplished by providing a container having a neck member forming an opening and a closure for closing the opening having a cylindrical skirt member fitting over the neck member. Complementary threads on the exterior of the neck and the interior of the skirt are engageable with each other to close the container. The threads on either the neck or the skirt are interrupted to form a gap and the complementary threads form a key to fit into the gap. The container is closed by threadably engaging the complementary threads and turning the closure relative to the container. Means are provided to prevent rotation in the opposite direction beyond a predetermined point making it necessary to align the closure and container in a predetermined orientation at which location the closure can be tilted relative to the container permitting opening of the container and removal of the closure.

The preferred embodiments of the invention are illustrated in the drawings in which:

FIGS. 6 and 7 are generally similar to FIGS. 4 and 5, respectively, and show a modification;

FIG. 8 is a side elevation of a modification of the invention;

FIG. 9 is a top view of the modification seen in FIG. 8; and

FIG. 10 is a cross-sectional view showing a modified form of seal which can be used with all embodiments of the invention.

Figure 1:
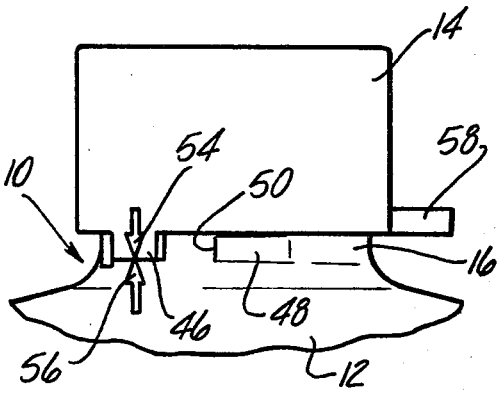
FIG. 1 is a view of a closure and a portion of a container forming an assembly embodying the invention.

A closure and container assembly embodying the invention is designated generally at 10 and includes a container 12 and a closure or cap 14 made of plastic material. The container 12 has a neck 16 and the closure 14 is generally cylindrical or cup-shaped with a disc-shaped top 18 and a cylindrical skirt 20.

The inner surface of the skirt 20 and the outer surface of the neck 16 have complementary threads 22 and 24, respectively, which engage each other to hold the closure 14 in a closed position relative to the opening 26 in the neck 16.

Figure 2:
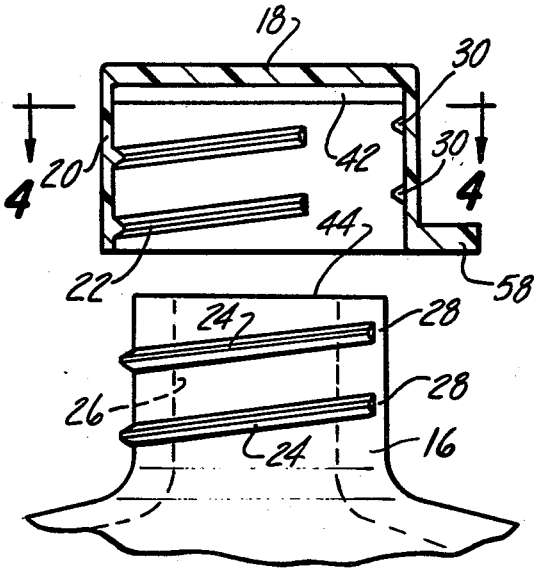
FIG. 2 is a view of the closure separated from the container with the closure being shown in cross-section.
Figure 3:
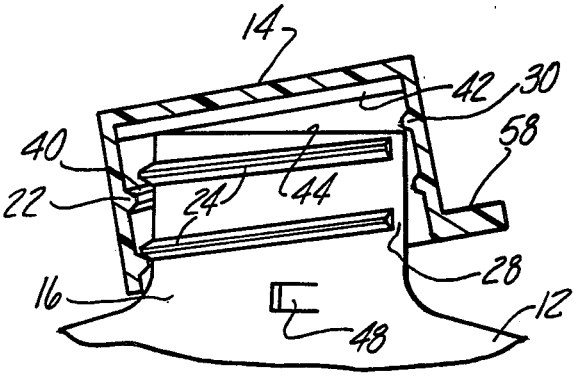
FIG. 3 is a view similar to FIG. 2 but showing the container and closure assembly during the opening operation.
Figure 4:
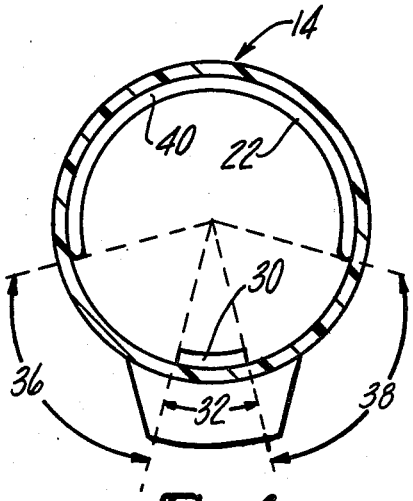
FIG. 4 is a cross-sectional view taken generally on line 4—4 in FIG. 2.
Figure 5:
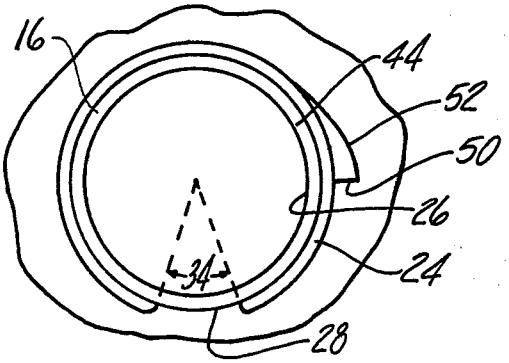
FIG. 5 is a top view of the upper portion of the container with the closure removed.

As seen in FIGS. 2 and 5 the neck has an interruption in the threads 24 which forms a gap or gate 28. The gate 28 extends axially of the neck to adjacent portions of the threads 24. The complementary threads 22 on the cap 14 are provided with a threaded portion 30 which extends through an arcuate span designated at 32 in FIG. 4 which is less than the arcuate span 34 defining the gate in FIG. 4. The threads 22 are interrupted to opposite sides of the key 30 with the span of the interruptions being designated at 36 and 38 in FIG. 4. As a result, the active thread portions of the cap 22 are formed by the key 30 and in a second threaded portion indicated at 40 in FIG. 4 diametrically opposite key 30 and extending through an arc of slightly more than one hundred eighty degrees.

Rotation of the cap 14 in an opening direction relative to the container 12 is limited by a tab 46 depending from a lower edge of the skirt 20 on the closure 14 which engages lock 48 formed integrally with the container 12 at the juncture of the neck 16 with the remainder of the container. One side of the lock 48 has a flat surface 50 which engages the tab 46 to prevent counterclockwise rotation of the closure 14. The lock 48 also has a ramp surface 52 as seen in FIG. 5 which serves to deflect the tab 46 axially outwardly sufficiently so that the closure 14 can be rotated in a clockwise direction during closing of the closure and container assembly 10.

To open the container and closure assembly 10, the closure 14 is rotated in an opening or counterclockwise direction relative to the container 12 until the key 30 on the closure 14 is brought into alignment with the gate 28 formed in the threads on the neck 16 of the container 12. Such alignment can be indicated by aligned indica 54 and 56 formed on the closure 14 and container 12, respectively, as indicated in FIG. 1. With the gate 28 and key 30 aligned the closure 14 can be tilted by means of a tab or handle 58 which will cause the closure 14 to tilt to disengage the threads 22 and 24 and permit removal from the neck 16.

Preferably, in the aligned position of the gate 28 and the key 30 which conditions the assembly 10 for opening, the tab 46 will be spaced from the surface 60 on the lock 48. This insures that turning movement of the closure in an opening direction until rotation is stopped by engagement of the tab 46 and lock 48 will not place the closure and container in condition for opening. Instead, rotation of the closure 14 from the lock engaged position is required in an opening direction for at least a short distance to bring the indica 54 and 56 into alignment with each other.

Referring now to FIGS. 6 and 7 a container 62 and a closure 64 are illustrated in which a gate 68 and a key portion 70 are reversed from the gate 28 and key 30 in FIGS. 1 through 5. The gate 68 is formed in threads 69 on the closure 64 and the key 70 is formed by a portion of the threads 71 on the container 62. In all other respects the container 62 and closure 64 are identical to the container 12 and closure 14 including the opening and closing operations.

Referring now to FIGS. 8 and 9 a modification of the embodiment of the invention seen in FIGS. 1 through 5 is illustrated in which the gate 28 is modified by a slot 74 which extends into the wall of the neck 16. This affords greater clearance for the key 30 relative to the neck 16 of the container 12 during opening movement of the closure 14. The gate 68 in FIG. 6 can be similarily modified to afford a greater clearance for the key portion 70 during opening movement of the closure 64 relative to the container 62.

When the closure 14 or 64 is in a closed position relative to the container 12 or 62, the complementary threads 22 and 24 can be used to exert considerable pressure to bring the liner 42 into sealing engagement with the lip 44 on the neck 16. However, in order to place the closure and container in condition for removal of the closure 14 or 64, it is necessary to bring the gates 28, 68 into alignment with the keys 30, 70. To accomplish this, it is necessary to rotate the closure 14 in an opening direction which although limited by the tab 46 and lock 48, can be sufficient to break the seal with the liner 42 and possibly cause leakage if the container 12 contains liquid. Such possible leakage can be avoided by arrangements such as that illustrated in FIG. 10 in which a closure 84 is held on the neck 86 of a container 82 by complementary threads 22 and 24 and which can be formed to operate in the same manner as container 12 and closure 14 or the container 62 and closure 64 except that a plug seal 88 was formed within the closure 14 to engage the inside diameter of the opening 26 with the neck 86. With such a plug seal 88 sealing engagement between the closure and container are maintained even though the closure is rotated in an opening direction until the tab 46 is brought into engagement with the lock 48. Such a seal arrangement and other suitable sealing arrangements can be found in prior U.S. Pat. Nos. 3,888,373 issued June 10, 1975, 3,971,487 issued July 27, 1976 and 3,986,626 issued Oct. 19, 1976. In all of these arrangements at least a limited amount of rotation in an opening direction permits a liquid seal to be maintained. With such sealing arrangements it is possible to employ the present invention giving snap or tilt type opening movement for containers of liquid which as a practical matter has usually been limited to fully threaded closures and containers.

The embodiments of the invention in which an exclusive privilege is claimed are defined as follows:

1. A container and closure assembly comprising: a container having a neck member forming an opening into said container, a closure for closing said opening having a cylindrical skirt member fitting over said neck member, complementary threads on the exterior of said neck member and the interior of said skirt member and being engageable with each other to close said container, said threads on one of said members being interrupted over a predetermined arcuate span to form a gap, said threads on the other of said members forming a first threaded portion having an arcuate span less than said predetermined span and a second threaded portion, said complementary threads being simultaneously engageable to permit rotation of said closure into sealing engagement with the neck member of said container, said closure being rotatable to a predetermined location relative to said container in which said first threaded portion is in alignment with said gap whereby said cap can be tilted to an open position.

2. The container and closure assembly of claim 1 and further comprising means permitting rotation of said closure in one direction relative to said container for closing said container and preventing reverse rotation beyond a predetermined limit.

3. The container and closure assembly of claim 2 wherein said means are engageable stop elements formed on said neck member and skirt member and are engageable with each other to prevent rotation at the location in which said key is out of alignment with said gap.

4. The container and closure assembly according to claim 1 wherein said second threaded portion extends through an arc substantially equal to one hundred eighty degrees.

5. The container and closure assembly of claim 1 wherein said threads on said closure and on said container are in engagement with each other through an arc at least equal to three hundred sixty degrees when said container is closed.

6. The container and closure assembly of claim 1 wherein interruptions are formed at opposite sides of said first and second threaded portions.

7. The container and closure assembly of claim 1 wherein said complementary threads on said closure and said container each extend through at least one and one-half of the perimeter of the skirt and closure, respectively.

8. The container and closure assembly of claim 1 and further comprising a sealing member on said closure for engaging the inner surface of said opening in said neck member to maintain a seal upon rotation of said closure a limited amount in an opening direction.

9. The container and closure assembly of claim 8 wherein said seal is operative to maintain said opening in said neck member closed and sealed between a fully closed position and approximately one full revolution of the closure from the fully closed position.

10. A container and closure assembly comprising: a container having a neck member formed an opening into said container, a closure for closing said opening having a cylindrical skirt member fitting over said neck member, complementary threads on the exterior of said neck member and the interior of said skirt member and being engageable with each other, said threads forming at least two full threads on each of said members, said threads on one of said members being interrupted over a predetermined arcuate span to form an axially extending gap in all of the threads on said one of said members, said threads on the other of said members forming a key having a arcuate span and extending axially through all of the threads, said threads on the other said member also forming another threaded portion disposed diametrically opposite said key, means permitting rotation of said closure in one direction relative to said container to permit threaded engagement of said closure and container and bring said closure into sealing engagement with the neck of said container and preventing reverse rotation beyond a predetermined limit, said predetermined limit being circumferentially spaced from said gap and first threaded portion, said closure being rotat-

BEST AVAILABLE COPY able to a location in which said first threaded portion is in alignment with said gap to permit tilting movement of said closure to an open position.

11. The container and closure assembly of claim 10 wherein said gap has a radial depth greater than the height of said threads to afford clearance for the threads forming said key.

* * * * *